United States Patent [19]

Lees et al.

[11] 4,311,114

[45] Jan. 19, 1982

[54] LOW SHEAR GRAVITY CONTROLLED YARN FINISH SUPPLY SYSTEM

[75] Inventors: Robert Lees, Chester; Marvin C. Jones, Chesterfield, both of Va.

[73] Assignee: Allied Corporation, Morris Township, Morris County, N.J.

[21] Appl. No.: 205,477

[22] Filed: Nov. 10, 1980

[51] Int. Cl.[3] ..... B05C 1/08

[52] U.S. Cl. ..... 118/694; 118/234; 118/244; 137/453

[58] Field of Search ..... 118/694, 693, 234, 29; 28/169, 178, 179, 180, 181; 137/386, 391, 453, 454

[56] References Cited

U.S. PATENT DOCUMENTS

| | | | |
|---|---|---|---|
| 2,420,355 | 5/1947 | Coleman | 137/453 |
| 3,365,326 | 1/1923 | Conrad | 118/694 |

*Primary Examiner*—Ralph S. Kendall

*Attorney, Agent, or Firm*—Richard A. Anderson

[57] ABSTRACT

In this invention yarn finish is supplied to the yarn applicator supply pan with the level controlled by intermittent admission of air to the top of a distribution tank through an air tube which is intermittently submerged and sealed with yarn finish at the same level as the supply pan. The tube opening is located within another tube connected to the bottom of the distribution tank with a tee which also connects to the supply pan. As the level of yarn finish in the supply pan drops due to use by the finish applicator, the level in the bottom tube also drops, uncovering the opening at the end of the top tube, permitting flow of air into the top of the distribution tank, releasing an equal amount of yarn finish through the tee and conduit to the supply pan, raising the level in the supply pan and the bottom tube until the opening of the top tube is covered and sealed preventing further flow of air until the level drops again due to use by the finish applicator, repeating the same intermittent supply process.

An automatic refilling apparatus for the distribution tank from a supply tank is also disclosed.

2 Claims, 3 Drawing Figures

LOW SHEAR GRAVITY CONTROLLED YARN FINISH SUPPLY SYSTEM

BACKGROUND OF THE INVENTION

This invention relates to a system to supply liquid yarn finish for application to synthetic or natural yarn, filament or fiber as it is being spun or otherwise processed as a moving continuous filament or group of filaments, fibers, yarn and the like. More specifically, the yarn finish supply system is pumpless, nonrecirculating and gravity fed, especially for handling shear-sensitive yarn finishes.

Previously, yarn finish supply systems were comprised of a supply tank with a bottom outlet connected by piping to a pump which provided the liquid finish to the finish applicator supply pan and recirculated any excess liquid in the supply pan through the pump and piping to prevent overflow. Certain yarn finishes such as those described in U.S. Pat. No. 4,192,754, hereby incorporated by reference, are sensitive to shearing of liquid, breaking down the finish emulsion.

The shearing action of the pump supplying and recirculating the finish to the finish applicator pan created a severe finish emulsion stability problem. This invention overcomes the emulsion shearing and stability problem by eliminating any shearing of the finish emulsion.

SUMMARY OF THE INVENTION

This invention to eliminate any shearing of the finish emulsion is a pumpless, nonrecirculating, low shear, gravity controlled, yarn finish supply system for yarn finishes sensitive to fluid shear comprising:

- a distribution tank
- finish applicator
- finish applicator supply pan
- a first tube opening vertically to the atmosphere above the level of the yarn finish in the finish applicator supply pan and communicating with
- a conduit between the distribution tank and the finish applicator supply pan
- a second tube communicating with the top of the distribution tank and this second tube extending downward into the first tube into an opening within the first tube just at the level of the yarn finish in the finish applicator supply pan, the opening being horizontal, whereby the yarn finish is supplied to the supply pan with level controlled by intermittent admission of air to the top of the distribution tank through the second tube; as the level of yarn finish in the supply pan drops due to use by the finish applicator, the level in the first tube, which communicates with the supply pan, also drops uncovering the opening at the end of the second tube permitting the flow of air, which flows through from the opening in the first tube and into the second tube into the distribution tank releasing an equal volume of yarn finish to flow through the conduit between the supply pan and the first tube, raising the level in both the pan and the first tube until the opening in the second tube is covered and sealed, preventing further flow of air until the level drops again due to use by the finish applicator, repeating the controlled level yarn finish supplying process.

In addition to the above apparatus, the system can also comprise:

- a supply tank

- conduit communicating between the supply tank and the distribution tank
- valves in each of the conduits communicating between the supply tank and the distribution tank and between the distribution tank and the finish applicator supply pan
- a liquid level switch at the bottom of the distribution tank
- a liquid level switch at the top of the distribution tank
- electrical wiring connecting each liquid level switch to
- electrical relay control means and means to open and close the valves. In this way the yarn finish is automatically supplied to the distribution tank from the supply tank by closing the valve, through the relay control means and means to open and close the valve, in the conduit between the distribution tank and the supply pan, by the yarn finish level being low enough to activate the liquid level switch at the bottom of the distribution tank which also opens, through the relay control means and means to open and close the valve, the valve in the conduit between the tanks; as the yarn finish level rises by flow through the conduit between the tanks it activates the liquid level switch at the top of the distribution tank which, through the relay control means and opening and closing means reverses the valve positions, closing the valve between the tanks, and opening the valve in the conduit between the distribution tank and supply pan.

DETAILED DESCRIPTION OF THE INVENTION

Figure 1:
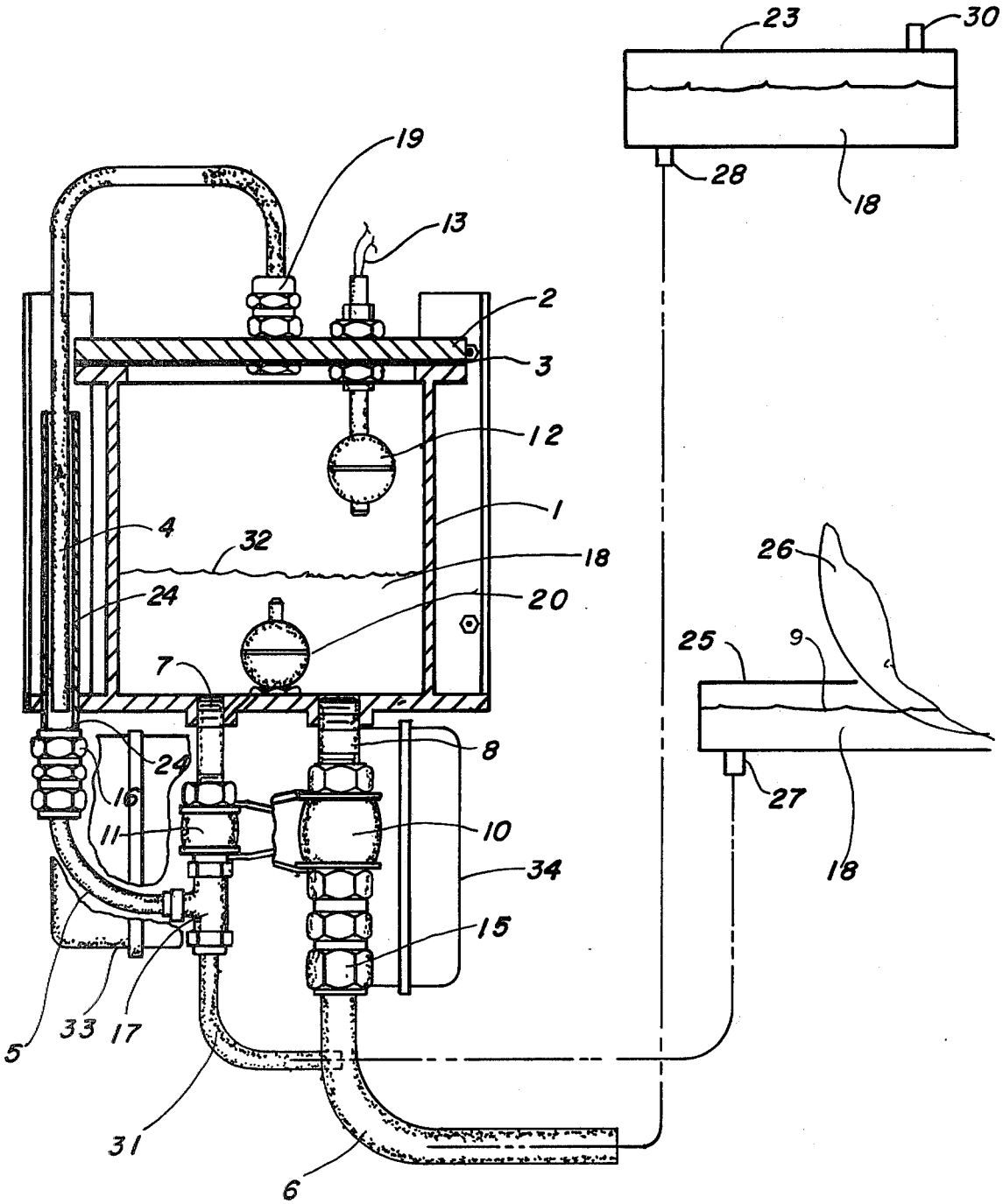
FIG. 1 is a partial cross-sectional view schematic of the apparatus of this invention.

FIG. 1 shows a partial cross-sectional view and schematic of the apparatus of this invention. Distribution tank 1 has cover 2 with gasket 3 to seal sight tube 4 connecting to the top of tank 1 with connector 19. Curved tube 5 connects at one end to tee 17 and at the other through reducing union 16 to open tube 24, which opens to the atmosphere around and above the lower end of tube 4. Curved tube 6 connects through connector 15, valve 10 and nipple 8 to tank 1 at one end and at the other end to supply tank 23 through connection 28. Supply tank 23 has vent 30. Distribution tank 1 also connects to tee 17 through nipple 7 and valve 11 and through curved tube 31 and through connection 27 to finish applicator supply pan 25. Pan 25 supplies liquid yarn finish 18 at level 9 which is the same horizontal level as the opening of tube 4 within tube 24. Distribution tank has within it upper liquid level switch 12 and lower liquid level switch 20. Electrical wiring 13 connects both liquid level switches to electrical relay control box 14 shown in FIG. 2. Finish applicator wheel 26 in supply pan 25 applies yarn finish to yarn on the other side of the rotating applicator wheel 26. The liquid yarn finish 18 has a typical level 32 within tank 1. Valve opening means 33 and 34, open and close valves 10 and 11, respectively.

Figure 2:
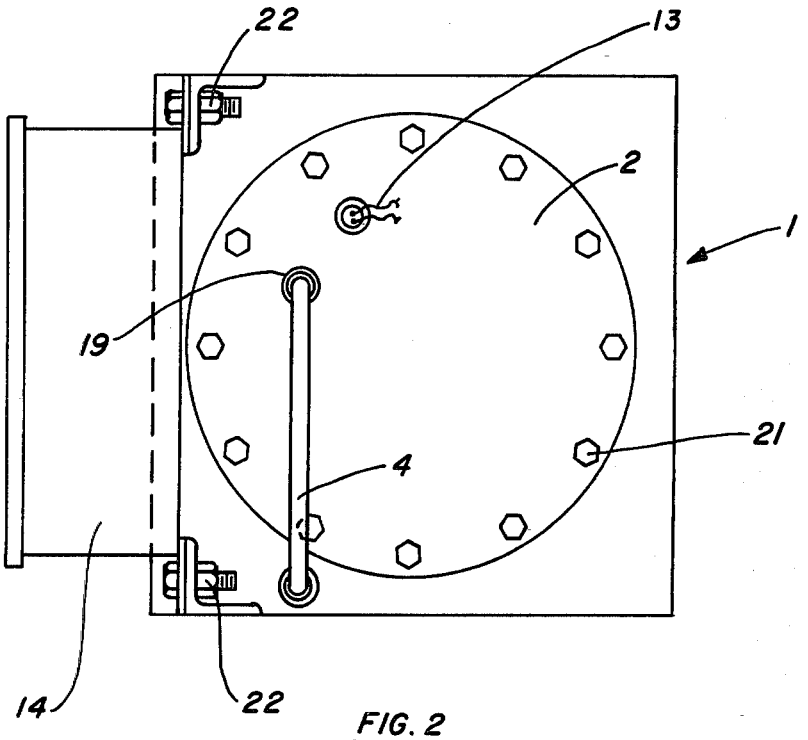
FIG. 2 is a top view of the distribution tank of this invention.

In FIG. 2 like numbers indicate like items. Hex bolts 21 secure cover 2 to tank 1. Hex bolts 22 secure tank 1 to its support frame. Electrical relay control box 14 holds the conventional electrical control system to control valves 10 and 11 activated by level switches 12 and 20 in distribution tank 1, which activate the valve opening means 33 and 34 through electrical wires 13 and the electrical relay control.

Figure 3:
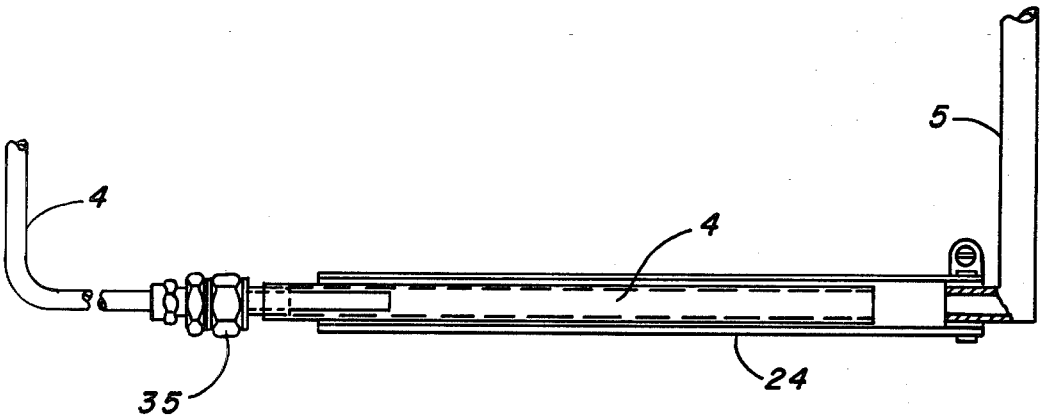
FIG. 3 is an alternate embodiment of the sight tube shown with an alternate embodiment of the curved tube of this invention.

In FIG. 3, tubes 4 and 5 are shown in an adjustable embodiment. Tube 4 can be manually raised and lowered by unscrewing the fitting 35 and tightening to hold it in place in open tube 24.

Operation of the apparatus is as described in the Summary of the Invention.

We claim:

1. A pumpless, nonrecirculating, low-shear, gravity controlled, yarn finish supply system for yarn finishes sensitive to fluid shear comprising a distribution tank a finish applicator a finish applicator supply pan a first tube opening vertically to the atmosphere above the level of yarn finish in the finish applicator supply pan and communicating with a conduit between the distribution tank and the finish applicator supply pan a second tube communicating with the top of the distribution tank and said second tube extending downward into said first tube and to an opening within the first tube just at the level of the yarn finish in the finish applicator supply pan, said opening being horizontal, whereby the yarn finish is supplied to the supply pan with level controlled by intermittent admission of air to the top of the distribution tank through the second tube; as the level of yarn finish in the supply pan drops due to use by the finish applicator, the level in the first tube, which communicates with the supply pan, also drops uncovering the opening at the end of the second tube permitting flow of air, which flows through from the opening in the first tube and into the second tube into the distribution tank releasing an equal volume of yarn finish to flow through the conduit between the supply pan and the first tube, raising the level in both the pan and first tube until the opening in the second tube is covered and sealed, preventing further flow of air until the level drops again due to use by the finish applicator, repeating the controlled level yarn finish supplying process.

2. A pumpless, nonrecirculating, low shear, gravity controlled, yarn finish supply system for yarn finishes sensitive to fluid shear comprising a supply tank a distribution tank a finish applicator a finish applicator supply pan a first tube opening vertically to the atmosphere above the level of yarn finish in the finish applicator supply pan and communicating with a conduit between the distribution tank and finish applicator supply pan a second tube communicating with the top of the distribution tank and said second tube extending downward into said first tube and to an opening within the first tube just at the level of the yarn finish in the finish applicator supply pan, said opening being horizontal conduit communicating between the supply tank and the distribution tank valves in each of the conduits communicating between the supply tank and distribution tank and between the distribution tank and the finish applicator supply pan a liquid level switch at the bottom of the distribution tank a liquid level switch at the top of the distribution tank electrical wiring connecting each liquid level switch to electrical relay control means and means to open and close said valves whereby the yarn finish is supplied to the supply pan with the level controlled by intermittent admission of air to the top of the distribution tank through the second tube; as the level of yarn finish in the supply pan drops due to use by the finish applicator, the level in the first tube, which communicates with the supply pan, also drops uncovering the opening at the end of the second tube permitting flow of air, which flows through from the opening in the first tube and into the second tube into the distribution tank releasing an equal volume of yarn finish to flow through the conduit between the supply pan and the first tube, raising the level in both the pan and first tube until the opening in the second tube is covered and sealed, preventing further flow of air until the level drops again due to use by the finish applicator, repeating the controlled level yarn finish supplying process; also whereby the yarn finish is automatically supplied to the distribution tank from the supply tank by closing the valve, through the relay control means and means to open and close the valve, in the conduit between the distribution tank and the supply pan, by the yarn finish level being low enough to activate the liquid level switch at the bottom of the distribution tank which also opens, through the relay control means and the means to open and close the valve, the valve in the conduit between the tanks; as the yarn finish level rises by flow through the conduit between the tanks it activates the liquid level switch at the top of the distribution tank which, through the relay control means and opening and closing means reverses the valve positions, closing the valve between the tanks and opening the valve in the conduit between the distribution tank and supply pan.

* * * * *